US006238261B1

(12) United States Patent
Lang

(10) Patent No.: US 6,238,261 B1
(45) Date of Patent: May 29, 2001

(54) LIGHT TRANSMITTING PEG FOR USE IN A TOY ILLUMINATING ASSEMBLY

(75) Inventor: Timothy J. G. Lang, Vancouver (CA)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 09/387,483

(22) Filed: Sep. 1, 1999

(51) Int. Cl.[7] ..... A63H 33/22

(52) U.S. Cl. ..... 446/219; 446/485; 446/91; 434/407

(58) Field of Search ..... 446/219, 91, 485; 40/548, 547, 579; 434/96, 407

(56) References Cited

U.S. PATENT DOCUMENTS

| | | | | |
|---|---|---|---|---|
| 3,897,951 | | 8/1975 | Morrison et al. | 273/121 A |
| 4,196,539 | | 4/1980 | Speers | 46/16 |
| 4,529,207 | | 7/1985 | Iseki et al. | 273/357 |
| 5,029,861 | | 7/1991 | Driska | 273/85 A |
| 5,057,051 | * | 10/1991 | Babicz | 446/227 |
| 5,324,224 | * | 6/1994 | Anderson | 446/91 |
| 5,391,105 | | 2/1995 | Jones | 446/219 |
| 5,876,262 | * | 3/1999 | Kelly | 446/118 |
| 6,032,393 | * | 3/2000 | Maxim | 40/548 |

* cited by examiner

*Primary Examiner*—Jacob K. Ackun, Jr.
*Assistant Examiner*—Kurt Fernstrom
(74) *Attorney, Agent, or Firm*—Barlow, Josephs & Holmes, Ltd.

(57) ABSTRACT

An improved light transmitting peg is constructed so as to eliminate uneven brightness spots when used in a toy illuminating assembly of the type including a housing, a peg board, and a light source mounted within the housing. The light transmitting peg includes an enlarged three-dimensional head portion, and at least one shaft portion that is inserted into an aperture in the peg board of the toy illuminating assembly. The three dimensional head shapes provide added play value and creative input from the user. The light transmitting pegs further incorporate a light masking material, such as an opaque coating, disposed on the distal ends of the shaft portions to eliminate or reduce bright spots, or hot spots, which are noticeably visible on the head portion of the peg when the masking material is absent. When the masking material is disposed on the distal ends of the shafts, enough light is blocked so that the entire head portion is provided with an even glow.

16 Claims, 4 Drawing Sheets

LIGHT TRANSMITTING PEG FOR USE IN A TOY ILLUMINATING ASSEMBLY

BACKGROUND AND SUMMARY OF THE INVENTION

The instant invention relates to toy arts and crafts devices in which light transmitting pegs are inserted into a peg board to form various patterns or pictures, and more particularly to such a device wherein a light source located behind the peg board transmits light through the pegs to enhance the pattern or design created.

A toy illuminating assembly of the type contemplated herein is currently being sold by the assignee of the present application, Hasbro, Inc., under the trademark LITE BRITE® (LITE BRITE is a registered trademark of Hasbro, Inc.). The LITE BRITE® device comprises a housing having a peg board into which light transmitting pegs of varying colors are inserted to form various patterns and designs. The pegs are cylindrical in shape, having a head portion and a slightly narrower shaft portion. Preferably, the pegs are manufactured from a transparent plastic which may be clear, or which may be tinted with a color. Clear and colored pegs having glitter material intermixed with the plastic are also known in the art. In use, the shaft portion of the peg is inserted into an aperture in the peg board so that the head portion remains positioned above the upper surface of the peg board. The distal end of the shaft portion is preferably pointed so that it can more easily pierce a sheet of paper which may be positioned over the upper surface of the peg board. The sheet may have a design formed thereon and may include markings for the location and color of a peg to aid the user in forming a design. A light source, such as a light bulb, is mounted within the housing, and light from the light source is transmitted through the pegs disposed in the peg board to illuminate the pegs and thus enhance the design.

Other embodiments of toy illuminating devices are disclosed in the U.S. patents to Speers U.S. Pat. No. 4,196,539, Anderson et al U.S. Pat. No. 5,324,224, Jones U.S. Pat. No. 5,391,105 and Kelley et al U.S. Pat. No. 5,876,262 which, other than the existing LITE BRITE device, represent the closest prior art to the subject invention of which the applicant is aware.

While the general concept of the present toy continues to remain popular, there is nevertheless a continuing need to improve this toy, and/or to develop unique accessories for the toy to further enhance its popularity and increase its play value.

In this regard, the instant invention provides an improved light transmitting peg for use in an illuminating assembly of the type described. The light transmitting peg includes an enlarged three-dimensional head portion, and at least one shaft portion that is inserted into an aperture in the peg board of the toy illuminating assembly. The three dimensional head provides added play value and added creative input from the user. The light transmitting pegs further include a light masking element, such as an opaque paint or coating, disposed on the distal end of the shaft portion. When the light masking material is absent from the peg, bright spots, or hot spots, are noticeably visible on the head portion of the peg when viewed from the front. However, when the masking material is disposed on the distal ends of the shafts, enough light is blocked so that the entire head portion is provided with an even glow. The number of the designs for the head portion is limitless, subject only to there being a sufficient number of shaft portions to maintain the peg on the peg board. In this regard, the peg preferably has at least two spaced shaft portions which will prevent rotation of the head portion when the shaft portions are inserted into corresponding spaced apertures in the peg board. Furthermore, the shaft portions of the peg preferably have a blunt end surface to prevent injury if the peg is inadvertently stepped on, or otherwise forced into the skin of the user.

Accordingly, among the objects of the instant invention are: the provision of an improved light transmitting peg for a toy illuminating assembly wherein the peg has an improved three dimensional head portion; the provision of a light transmitting peg wherein the head portion is shaped in a three-dimensional design and the upper surface of the head portion has an ornamental surface design formed therein; the provision of a light transmitting peg having at least one shaft portion which is inserted into a peg board of the toy illuminating assembly; the provision of a light transmitting peg having at least two shaft portions; the provision of a light transmitting peg wherein the shaft portion has a blunt end surface; the provision of a light transmitting peg having a light masking element disposed on the distal end of the shaft portion to prevent hot spots or bright spots when the peg is viewed from the front; and the provision of such a light transmitting peg wherein the light masking element preferably comprises a light masking material that is painted or coated onto the distal end of the shaft portion of the peg.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
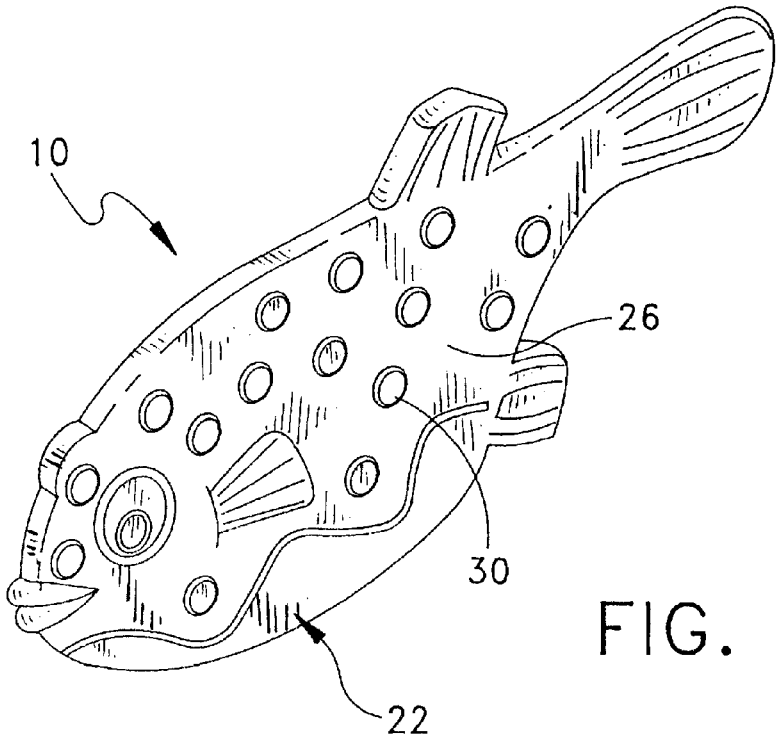
FIG. 1 is a front perspective view of the light transmitting peg of the present invention.
Figure 2:
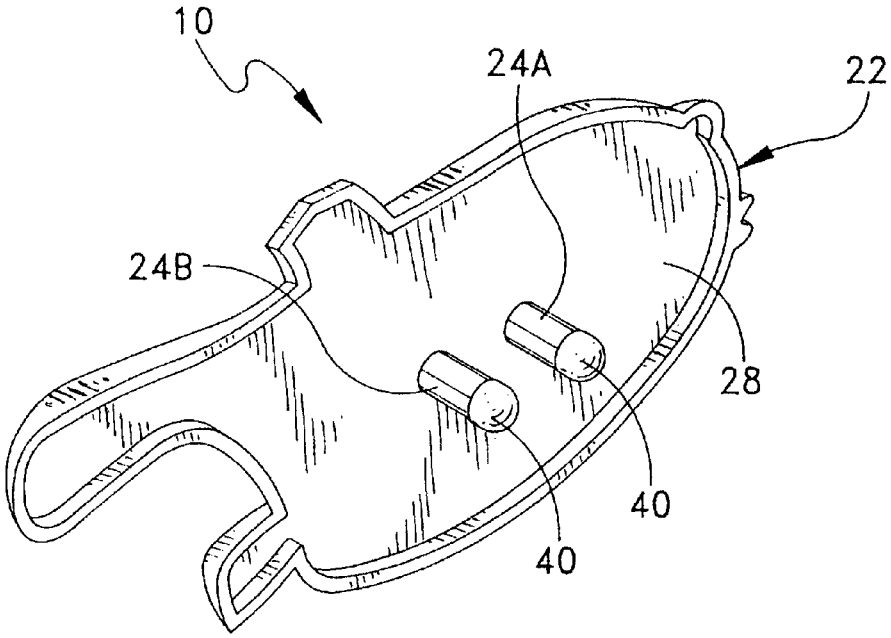
FIG. 2 is a rear perspective view thereof.
Figure 3:
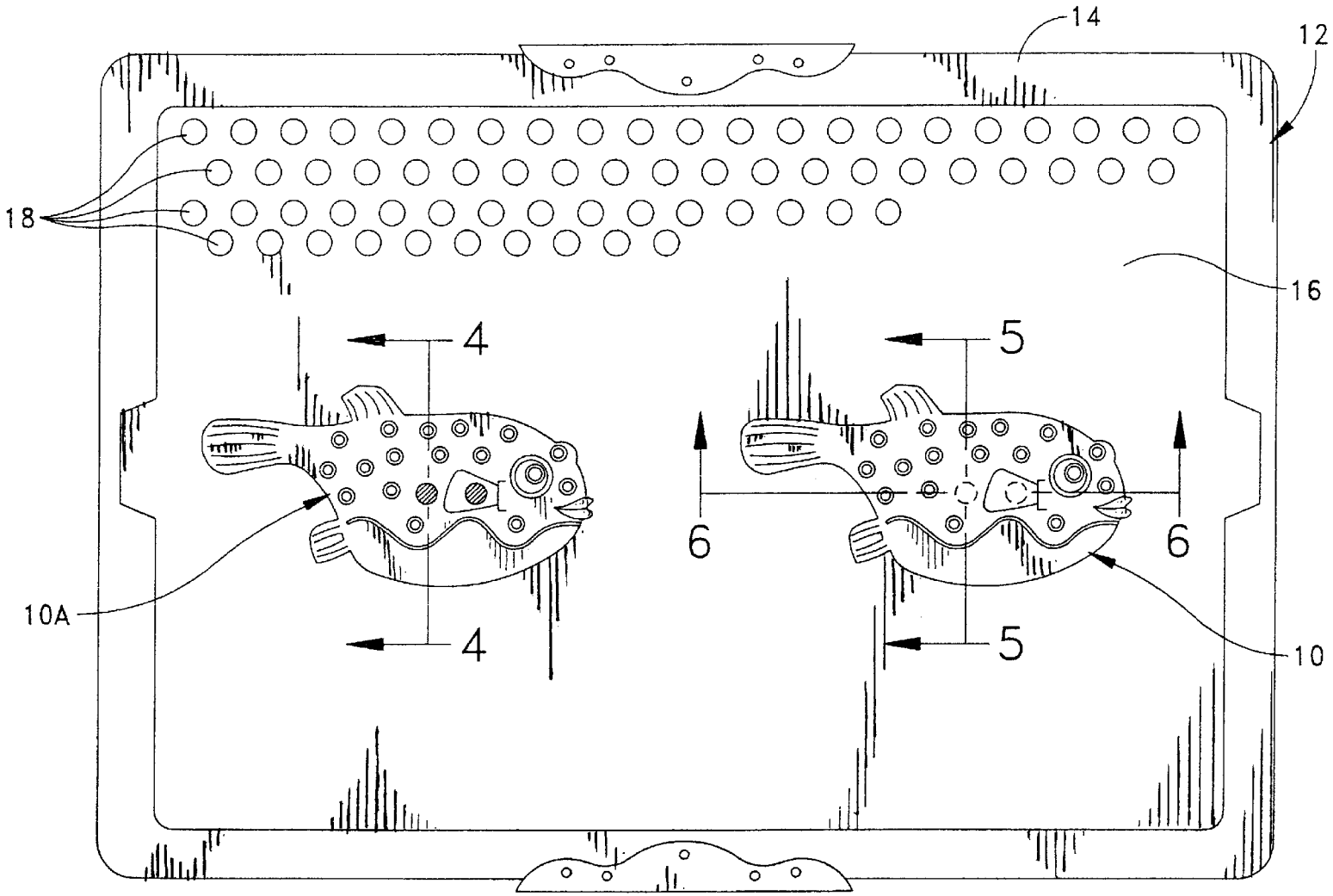
FIG. 3 is a front view of a toy illuminating assembly on which two light transmitting pegs are mounted for comparison wherein the left hand peg has shaft portions which do not include a light masking material and the right hand peg has a light masking material disposed on the distal end of the shafts.

Referring now to the drawings, the improved light transmitting peg of the instant invention is illustrated and generally indicated at 10 in FIGS. 1–6. As will hereinafter be more fully described, the instant invention provides an improved light transmitting peg 10 for use in an illuminating assembly 12 of the type comprising a housing 14, a peg board 16 having a plurality of geometrically arranged apertures 18 therein, and a light source 20 mounted within the housing 14. The light transmitting pegs 10 of the present invention are intended to be inserted into the peg board 16 to form various patterns or pictures wherein the light source 20 located behind the peg board 16 transmits light through the pegs 10 to enhance the pattern or design created.

More specifically, the light transmitting peg 10 comprises an enlarged three-dimensional head portion 22, and two spaced shaft portions 24 that are inserted into spaced aperture 18 in the peg board 16 of the toy illuminating assembly 12. In most embodiments of the peg 10, it is preferable to have at least two spaced shaft portions 24A, 24B which are received into spaced apertures 18 in the peg board 16, although the use of a singe shaft 24 is contemplated within the scope of the invention. The use of two spaced shaft portions 24 is preferred because the two shaft portions 24 lock the peg 10 in a predetermined location and prevent rotation of the peg 10 relative to the peg board 16. The shaft portions 24 are preferably spaced so that they do not rest within apertures 18 which are immediately adjacent to one another (See FIG. 6).

The pegs 10 are preferably molded from a transparent, substantially rigid polymer material, such as polyvinyl chloride. The plastic may be entirely transparent, or may be tinted with a coloring material as is well known in the art. Alternatively, the peg 10 may be formed from a translucent plastic and/or include glitter material, or other filler materials which enhance the lighted effect of the peg 10.

The head portion 22 is preferably molded in a three-dimensional ornamental shape, such as the shape of a fish, as illustrated herein. The head portion 22 is thus provided with outer peripheral margins that mimic the shape of the fish and is further provided with three-dimensional depth. In this regard, the head portion 22 has upper and lower surfaces, 26, 28 respectively, the upper surface 26 thereof being provided with a ornamental design 30 formed therein which adds depth and contour to the overall design of the head portion, the lower surface 28 being hollowed out to provide a suitable wall thickness for the transmission of light through the head portion 22. While hollowing out of the lower surface 28 lowers the use of plastic and provide better light transmission characteristics, it is to be understood that such hollowing out of the lower surface 28 is not intended to limit the scope of the invention, and that head portions having a flat lower surface are also contemplated. The exterior surface of the peg, particularly the ornamental upper surface 30 of the head portion 22, may include a paint or other coloring material which enhances the light effect. The three dimensional head portion 22 provides added play value and permits a greater level of creative input from the user. While a single ornamental design of the head portion 22 is illustrated herein, it is to be understood that the scope of the invention is not limited to the disclosed design, and it is further understood that the scope of designs is potentially unlimited.

Figure 4:
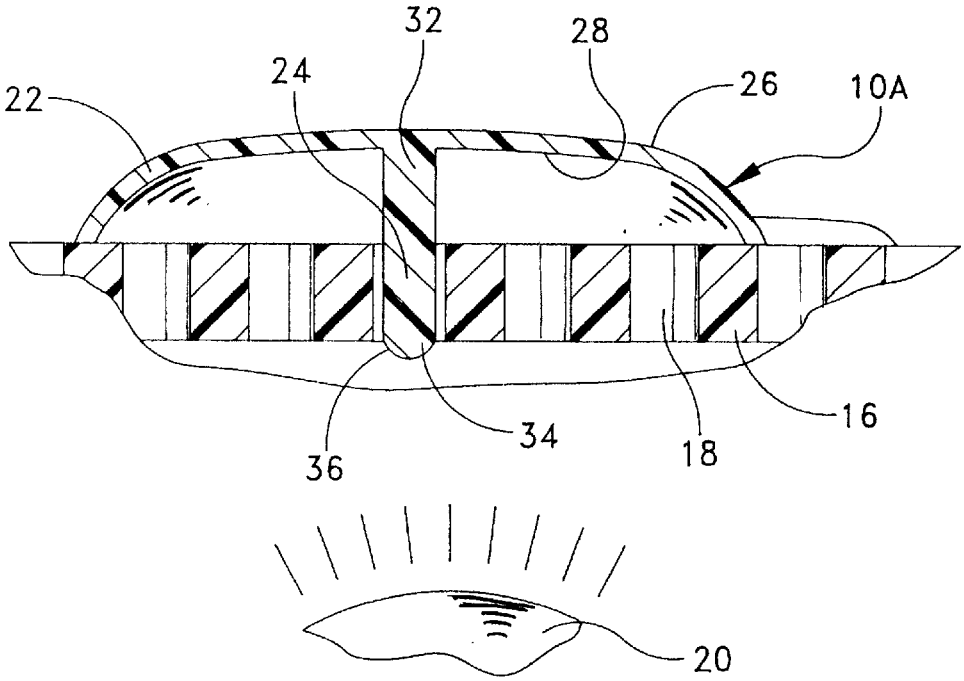
FIG. 4 is a cross-sectional view thereof as taken along line 4—4 of FIG. 3.
Figure 5:
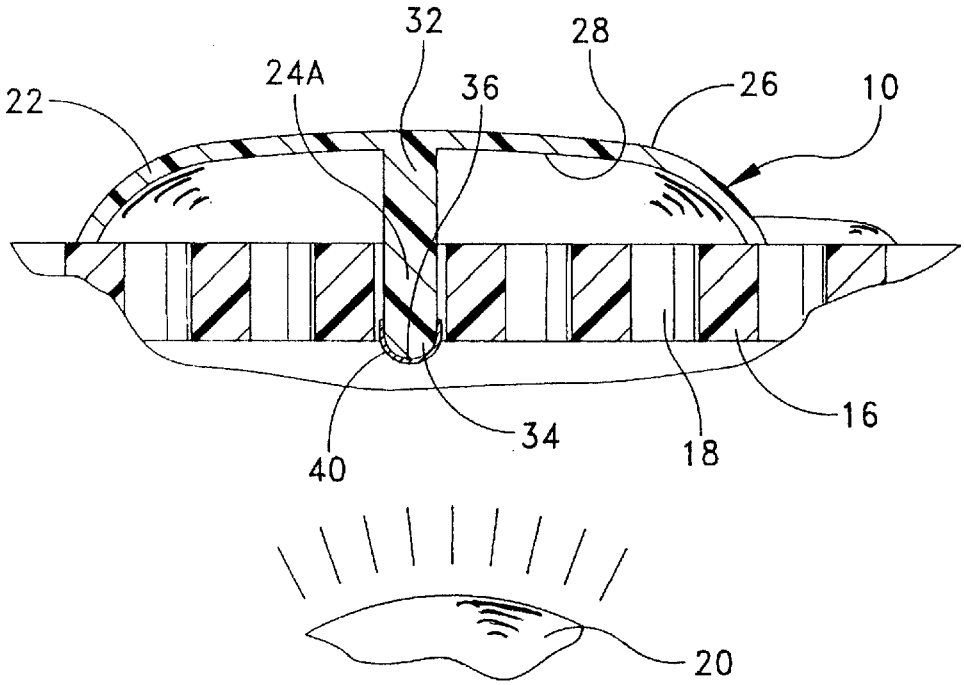
FIG. 5 is another cross-sectional view thereof as taken along line 5—5 of FIG. 3.
Figure 6:
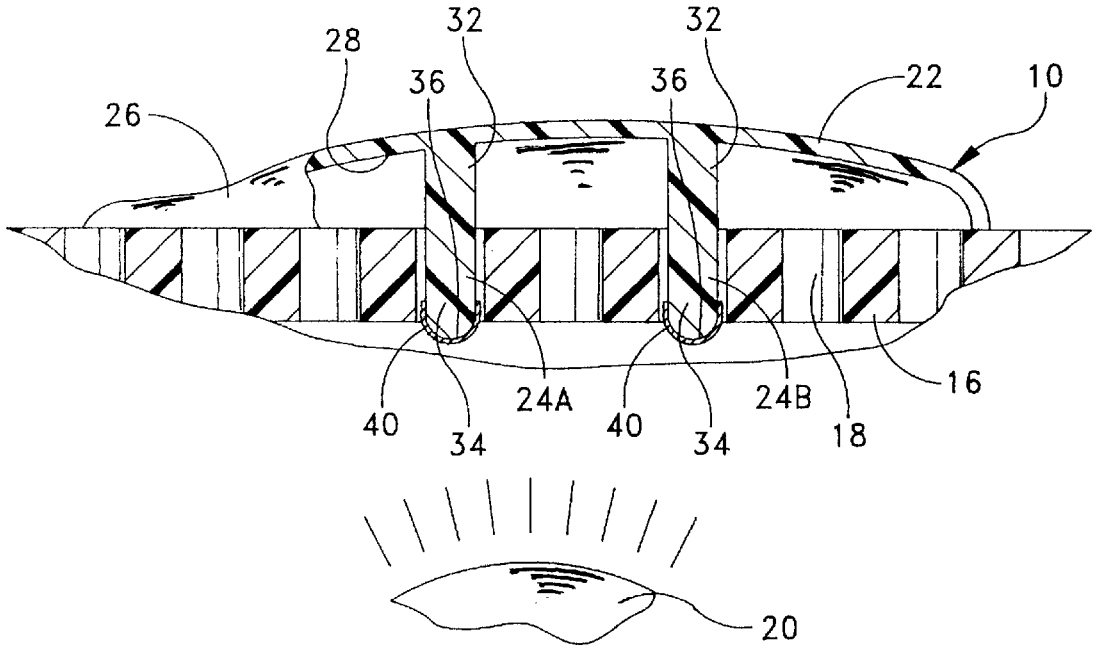
FIG. 6 is yet another cross-sectional view thereof as taken along line 6—6 of FIG. 3.

The shaft portions 24 are preferably integrally molded with the head portion 22 wherein the proximal ends 32 of the shaft portions 24 are attached to, and depend from a "central area" of the lower surface 28 of the head portion 22. Central area is intended to define an area of the lower surface of the head portion within the peripheral edge thereof, and it is noted that it is preferable that the shaft portion 24 depend downwardly from this central area of the head portion rather than depending from the outer peripheral edges thereof. The shaft portions 24 further include a distal end 34 remote from the head portion 22 which is intended to be inserted into one of the plurality of apertures 28 in the peg board 16. Unlike the prior art peg, the distal ends 34 of the shaft portions 24 preferably have a blunt, i.e. rounded or otherwise chamfered, end surface 36 to prevent injury should the peg 10 be inadvertently stepped on or otherwise forced into the skin of the user. Turning to FIGS. 4–6, the shaft portions 24 are long enough to permit insertion into the peg board 16 with a small part thereof extending beyond the inner surface of the peg board 16. This length assures that the peg 10 will be securely held in place during play. It is pointed out that the peg 10 illustrated in FIGS. 4–6 is inserted into the peg board 16 without an underlying sheet of paper. In this regard, all of the apertures 18 located beneath the head portion 22 are open to allow light to be transmitted upwardly to illuminate the entire head portion 22. However, due to the closer proximity of the protruding end surface 36 to the light source 20, the protruding end surface 36 causes bright spots, or hot spots 38, which are noticeably visible on the head portion of the peg 10 when viewed from the front (See FIG. 3 left hand model).

In order to minimize the bright spots 38 and create a more even glow to the head portion 22, the light transmitting pegs 10 include a light masking element 40, such as a paint or colored coating material, disposed on the distal ends of the shaft portions. The light masking element 40 preferably comprises a solvent or water based paint or coating suitable for use on polyvinyl chloride, which is the preferred plastic material used for the pegs 10. This arrangement is used to partially mask or partially block light from entering into the end surfaces 36 of the shaft portions 24. The light masking material 40 is preferably white in color, as opposed to other darker colors. Since the masking material 40 is an opaque white color, it is preferable that the masking material 40 be applied in a thickness which does not completely mask all light from being transmitted through the material 40. In the preferred embodiments as illustrated herein, the masking material 40 is a white lacquer paint that is sprayed onto the distal ends 34 of the shaft portions 24 in a thickness that is sufficient to partially, but not completely, block the transmission of light therethrough. The light masking material 40 is preferably sprayed over the distal end 34 so as to cover the entire end surface 36 up to the hemisphere line, but may fall short of the hemisphere line or extend slightly beyond the hemisphere line, partially up the side of the shaft portion 24.

As indicated above, when the light masking element 40 is absent from the peg 10, bright spots, or hot spots 38, are noticeably visible on the head portion 22 of the peg 10 when viewed from the front. However, when the masking element 40 is disposed on the distal ends 34 of the shaft portions 24, enough light is blocked so that the entire head portion 22 is provided with an even glow. The term "light masking element" as used herein is intended to define all types of added materials or configurations of the shaft portion 24 which may provide the appropriate light masking effect as described. Other light masking elements and implementations are also contemplated within the scope of the present disclosure. For example, the light masking material 40 may be coated into the mold prior to molding such that the material becomes imbedded within the plastic, or becomes intermixed with the plastic. As such, the masking material 40 would not be applied to the exterior of the shaft portion 24. Other potential embodiments may mold the entire shaft portion 24 of a different opaque or translucent plastic material which would have the same effective. Accordingly, while a specific embodiment of the "light masking element" is disclosed herein, the scope of the term is not limited by these representative examples, but rather is intended to encompass any equivalent structure for blocking light from travelling directly through the shaft portion 24 of the peg 10.

Figure 7:
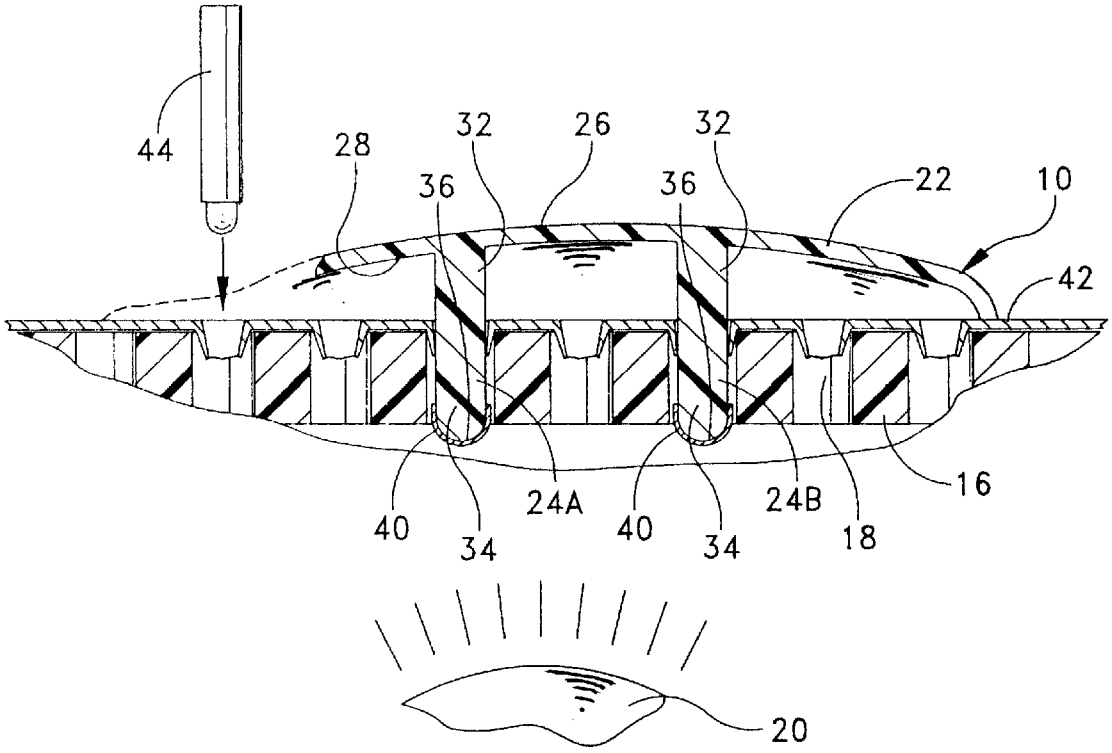
FIG. 7 is still another cross-sectional view thereof showing use of the light transmitting peg with a sheet of design paper positioned over the peg board, and further showing use of a punch tool for punching holes in the design sheet beneath the body portion of the peg.

Referring to FIG. 7, it is contemplated that the present pegs 10 will be sold as an accessory kit, including a plurality of different types of pegs 10, a plurality of design sheets 42 bearing designs and background scenes appropriate for use with the accompanying pegs, and a punch tool 44. When the light transmitting pegs 10 are to be used with the sheet of design paper 42 disposed over the peg board 16, it is preferable to punch holes 46 in the paper through each of the apertures 18 underlying the head portion 22 of the peg 10 to permit light to be transmitted upwardly. In this regard, the punch tool 44, or other tool, such as a pen or pencil, is utilized to punch the holes 46 in the appropriate locations. The design sheets 42 will preferably bear outlines of the peg shapes to be located in particular locations and will allow the user to punch all of the holes located within the outline. If the holes are not punched, light is only exposed to the distal ends 34 of the shaft portions 24, and creates the same undesired bright spots 38.

It is also noted that proper spacing of the shaft portions 24 further minimizes the appearance of bright spots that might be exaggerated by a close pairing of the shaft portions 24.

It can therefore be seen that the present invention provides an improved light transmitting peg 10 for a toy illuminating assembly 12 wherein the peg 10 has an improved three dimensional head portion 22. The provision of a light transmitting peg 10 wherein the head portion 22 is shaped in a three-dimensional design and the upper surface 26 of the head portion 22 has an ornamental surface design 30 formed therein has added play value and allows a greater artistic and creative input from the user. In addition, the use of a light masking element 40 disposed on the distal end 34 of the shaft portion 24 effectively reduces the appearance of hot spots or bright spots 38 when the peg 10 is viewed from the front thus adding to the aesthetic value of the pattern or design created. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A light transmitting peg comprising:

an ornamental head portion having an upper surface and a lower surface, said upper surface having an ornamental design provided thereon, said lower surface having a central region;

a shaft portion having a proximal end attached to said central region of the lower surface of said head portion and further having a distal end remote from the head portion, said head portion and said shaft portion being fashioned from a light transmitting material; and means for masking light transmission entering through the distal end of said shaft portion, said means for masking covering an entire surface area of said distal end of said shaft portion to uniformly diffuse said light transmission through said shaft portion and to thereby to achieve a uniform glowing diffuse illumination of said head portion.

2. The light transmitting peg of claim 1 wherein said means for masking light transmission through the shaft portion comprises a light masking element disposed on the distal end of the shaft portion.

3. The light transmitting peg of claim 1 wherein said means for masking light transmission through said shaft portion comprises a coating of light masking material disposed on the distal end of said shaft portion.

4. The light transmitting peg of claim 1 wherein said head portion is formed in a three dimensional ornamental shape.

5. The light transmitting peg of claim 1 wherein said distal end of said shaft portion as a blunt end surface.

6. The light transmitting peg of claim 5 wherein said blunt end surface is rounded.

7. The light transmitting peg of claim 1 further comprising a second shaft portion having a proximal end attached to the lower surface of the head portion, and further having a distal end remote from the head portion.

8. The light transmitting peg of claim 7 wherein said first and second shaft portions are spaced apart so as to be received into apertures of a peg board which are not immediately adjacent to one another.

9. A light transmitting peg comprising:

an ornamental head portion having an upper surface and a lower surface, said upper surface having an ornamental design provided thereon, said lower surface having a central region;

a shaft portion having a proximal end attached to said central region of the lower surface of the head portion and further having a distal end remote from the head portion, said head portion and said shaft portion being fashioned from a light transmitting material; and a light masking element disposed on the distal end of said shaft portion, said light masking element covering an entire surface area of said distal end of said shaft portion to uniformly diffuse said light transmission through said shaft portion and to thereby to achieve a uniform glowing diffuse illumination of said head portion.

10. The light transmitting peg of claim 9 wherein said head portion is formed in a three-dimensional ornamental shape.

11. In combination, a toy illuminating assembly comprising a peg board having a plurality of spaced apertures extending therethrough, and a light source positioned adjacent to the peg board; and a light transmitting peg comprising an ornamental head portion having an upper surface and a lower surface, said upper surface having an ornamental design provided thereon, said lower surface having a central region;

a shaft portion having a proximal first end attached to said central region of the lower surface of the head portion and a second distal end remote from the head portion, said head portion and said shaft portion being fashioned from a light transmitting material, said distal end of said shaft portion being inserted into an aperture of said peg board of said toy illuminating assembly; and a light masking element disposed on the distal end of said shaft portion, said light masking element covering an entire surface area of said distal end of said shaft portion to uniformly diffuse said light transmission through said shaft portion and to thereby to achieve a uniform glowing diffuse illumination of said head portion.

12. The light transmitting peg of claim 11 wherein said shaft portion has a length such that at least part of said distal end thereof extends beyond an inner surface of said peg board, said masking element substantially entirely covering said part of said distal end that extends beyond said inner surface of said peg board.

13. The light transmitting peg of claim 11 wherein light masking element comprises a coating of light masking material disposed on the distal end of said shaft portion.

14. The light transmitting peg of claim 11 further comprising a second shaft portion having a proximal end attached to the central region of said lower surface of the head portion, and further having a distal end remote from the head portion.

15. The light transmitting peg of claim 14 wherein said first and second shaft portions are spaced apart so as to be received into apertures in said peg board which are not immediately adjacent to one another.

16. The toy illuminating assembly of claim 11 further comprising a paper sheet covering said peg board blocking the transmission of light from said light source through said apertures, said distal end of said ornamental peg being inserted through said paper sheet.

* * * * *